US007063626B2

(12) United States Patent
Cardosi

(10) Patent No.: US 7,063,626 B2
(45) Date of Patent: Jun. 20, 2006

(54) GOLF TEACHING AND TRAINING DEVICE

(76) Inventor: James A. Cardosi, 2065 S. Hieland Rd., St. Anne, IL (US) 60964

( * ) Notice: Subject to any disclaimer, the term of this patent is extended or adjusted under 35 U.S.C. 154(b) by 0 days.

(21) Appl. No.: 11/077,319

(22) Filed: Mar. 10, 2005

(65) Prior Publication Data

US 2005/0197199 A1 Sep. 8, 2005

Related U.S. Application Data

(63) Continuation-in-part of application No. 10/347,006, filed on Jan. 17, 2003, now Pat. No. 6,932,712.

(51) Int. Cl.
*A63B 69/36* (2006.01)

(52) U.S. Cl. ..... 473/257; 473/266; 473/270; 473/278

(58) Field of Classification Search ..... 473/211, 473/219, 257, 261, 262, 263–279; D21/791; 273/DIG. 17, DIG. 30
See application file for complete search history.

(56) References Cited

U.S. PATENT DOCUMENTS

| | | | | |
|---|---|---|---|---|
| 2,340,793 A | | 2/1944 | Chapman | 473/229 |
| 2,606,026 A | | 8/1952 | Young | 473/218 |
| 2,707,638 A | | 5/1955 | Manley | 473/218 |
| 2,891,796 A | * | 6/1959 | Cottrell | 473/277 |
| 3,375,010 A | | 3/1968 | Panza | 473/264 |
| 3,510,135 A | | 5/1970 | Gentile | 473/270 |
| 3,554,555 A | | 1/1971 | Macri | 473/264 |
| 3,561,764 A | | 2/1971 | Thomas | 473/257 |
| 3,685,835 A | | 8/1972 | Fahy | 473/229 |
| 3,942,802 A | | 3/1976 | Wright | 473/264 |
| 4,000,905 A | | 1/1977 | Shirhall | 473/218 |
| 4,023,810 A | | 5/1977 | Lorang | 473/218 |
| 4,101,130 A | | 7/1978 | Richards | 473/270 |
| 4,164,352 A | | 8/1979 | O'Brien | 473/218 |
| 4,248,431 A | | 2/1981 | Burnes | 473/270 |
| 4,355,810 A | | 10/1982 | Rydeck | 473/218 |
| 4,513,972 A | * | 4/1985 | Empie | 473/274 |
| 4,915,387 A | | 4/1990 | Baxstrom | 473/218 |
| 4,998,731 A | | 3/1991 | Bowen | 473/271 |
| 5,013,044 A | | 5/1991 | Hesselbart | 473/218 |
| 5,074,565 A | | 12/1991 | Tucker | 473/229 |
| 5,163,686 A | | 11/1992 | Bergman | 473/218 |
| D332,815 S | * | 1/1993 | Rivas | D21/791 |
| 5,303,926 A | | 4/1994 | Owens et al. | 473/261 |
| 5,306,011 A | | 4/1994 | Perry | 473/218 |
| 5,375,833 A | | 12/1994 | Marier, Jr. | 473/261 |
| 5,439,226 A | * | 8/1995 | Luedtke | 473/232 |

(Continued)

OTHER PUBLICATIONS

"Inside Approach" device shown in www.golfaroundtheworld.com website. Information was printed off website on Jan. 8, 2003.

*Primary Examiner*—Nini F. Legesse
(74) *Attorney, Agent, or Firm*—Olson & Hierl, Ltd.

(57) ABSTRACT

A multi-positional swing training device having adjustable configurations suitable for addressing a plurality of swing flaws, such as with a golf swing, is provided. The training device includes a base, and an upright member extending vertically from the base. An elongate arm extends from the upright member and a guide member extends from the distal end of the arm. The position of the arm and guide member relative to the base is adjustable into any variety of positions to address different swing flaws.

13 Claims, 6 Drawing Sheets

U.S. PATENT DOCUMENTS

| | | | | |
|---|---|---|---|---|
| 5,478,082 | A | 12/1995 | De Knight et al. | 473/218 |
| 5,634,858 | A * | 6/1997 | Bellagamba | 473/257 |
| 5,762,565 | A * | 6/1998 | Milam et al. | 473/271 |
| 5,769,732 | A | 6/1998 | O'Neal | 473/258 |
| 5,807,185 | A | 9/1998 | Raubuck et al. | 473/229 |
| 5,899,816 | A | 5/1999 | Pearson | 473/265 |
| 6,077,169 | A | 6/2000 | Florian | 473/278 |
| 6,482,102 | B1 | 11/2002 | Grabowski | 473/270 |
| 6,572,486 | B1 | 6/2003 | Sweinhart | 473/257 |
| 6,932,712 | B1 * | 8/2005 | Cardosi | 473/261 |
| 6,949,030 | B1 * | 9/2005 | Gauer | 473/257 |
| 2004/0198525 | A1 * | 10/2004 | Bender | 473/207 |

* cited by examiner

FIG. 8
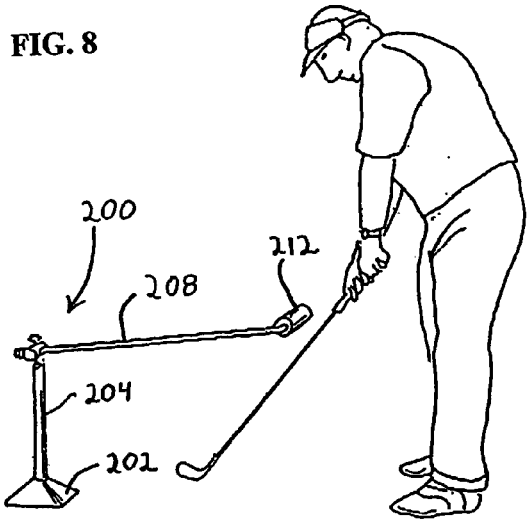
FIG. 9
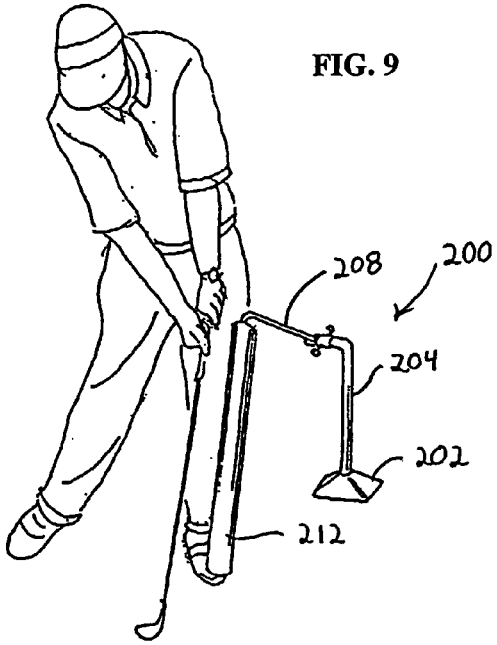
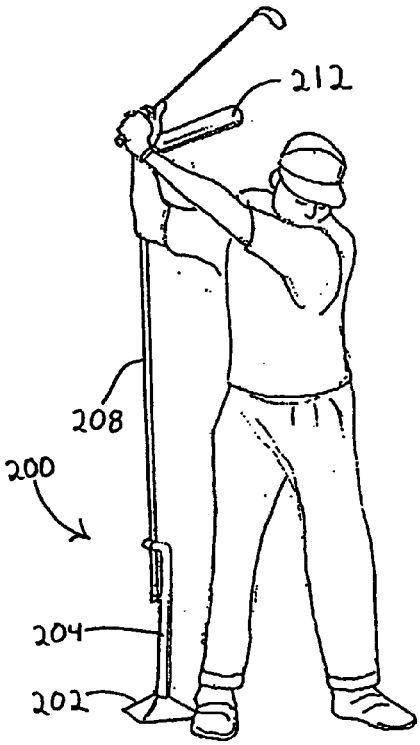
FIG. 11
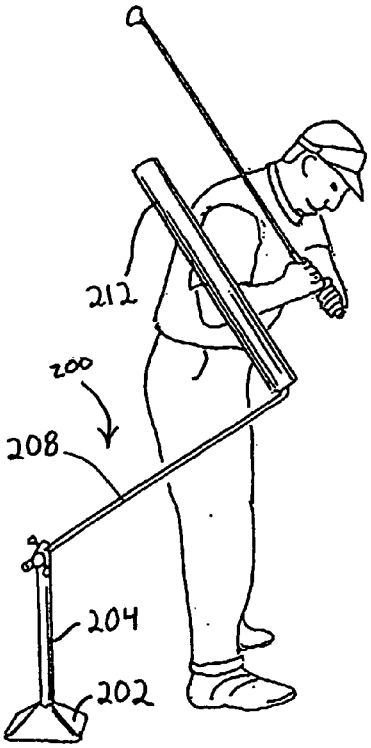
FIG. 10

GOLF TEACHING AND TRAINING DEVICE

CROSS REFERENCE TO RELATED APPLICATION

This application is a continuation in part of Application No. 10/347,006 filed Jan. 17, 2003 (U.S. Pat. No. 6,932,712).

FIELD OF THE INVENTION

This invention relates to a golf teaching and training device and, more particularly, to a device for improving a golfer's swing, putting stroke and stance.

BACKGROUND OF THE INVENTION

A multitude of golf teaching and training aids and devices have been developed over the years. Several of the currently available devices, however, have proven unsatisfactory in part because they only allow a golfer to practice his/her swing, putting stroke and/or stance through simulation rather than as a result of repeating and performing the actual correct swing, putting stroke and/or stance by hitting actual golf balls toward an actual target.

Another disadvantage associated with currently available golf teaching aids and devices is that they are typically directed to simulating or improving only one of the several fundamental facets of a golfer's game at a time such as, for example, the golfer's swing, putting stroke and/or stance. As a result, golfers have been required to purchase a different aid or device for each of the intended fundamental facets sought to be improved.

Another disadvantage is the lack of a portable device capable of being set up quickly and capable of both indoor and outdoor use. Still another disadvantage is the lack of a non-simulation type device capable of effectively eliminating one of the most common incorrect swings used by a majority of golfers, i.e., the incorrect "over the top" or "casting" swing which most typically results in a "slicing" golf ball that veers off of its intended straight target line.

The present invention is directed to a golf training and teaching device which addresses these and other disadvantages associated with currently available golf training aids and devices.

SUMMARY OF THE INVENTION

The present invention is directed to a golf teaching and training device which allows a golfer to repeat and perform the actual golf swing, putting stroke and/or golf stance which the golfer seeks to improve by hitting and putting actual golf balls toward an actual target rather than by simply simulating these various fundamental facets of a successful golf game. The invention also provides a single device which allows a golfer to practice the several different fundamental facets necessary for a successful golf game and is adapted to, among other things: eliminate the "over the top" swing by forcing the correct takeaway and inside swing path; provides a proper swing plane alignment with the intended target; eliminates excessive inside swing paths; insures a straight back and forth putting stroke; and provides for the proper foot and ball placement.

More particularly, the golf training and teaching device initially comprises a frame or stand adapted to extend upwardly from a playing surface and a barrier member extending away from the frame. In one embodiment, the frame includes a pair of spaced-apart posts and a crossbar extends therebetween in spaced apart relationship from the playing surface and the barrier member comprises an arm extending away from and pivotable relative to the frame. Additionally, a second arm or guide member, which may be padded, extends from a distal end of the first arm and is rotatable about the end of the first arm so as to allow the positioning of the arms into relationships wherein a golf club is adapted to be swung either beneath and/or in front of the arms depending upon the intended use.

The device also may include a golf club guide track which extends away from the frame in a relationship spaced from the playing surface and a slide associated with the guide track and adapted for sliding back and forth movement along the track whereby the shaft of a putter is adapted to be secured to the slide for back and forth movement relative to the track and the frame.

In one embodiment, a first pair of spaced-apart arms extend outwardly from the frame and the guide track comprises a second pair of spaced-apart arms extending between the first pair of arms in a relationship generally normal to the first pair of arms and generally parallel to the playing surface and the slide extends between the second pair of arms and is slidable along the second pair of arms. A clip associated with the slide is adapted to releaseably receive the shaft of the golf club.

The frame may also include a weighted base and a pair of posts which extend generally upwardly therefrom in spaced apart relationship. In this embodiment, the first pair of arms extend outwardly from the pair of posts respectively.

The device may additionally include a mat adapted to be positioned under the frame and over the support surface. The mat includes respective foot placement markings and golf ball placement markings positioned generally below the elongate arm and spaced a selected distance from the respective foot placement markings. The mat may also further include a plurality of swing target markings aligned with the plurality of foot placement markings respectively, a plurality of club face guide markings aligned with the plurality of golf ball placement markings respectively, and a pair of spaced apart elongate putting guide markings. The respective markings may comprise either solid lines on the mat or cut-outs formed in the mat.

Other features and advantages of the present invention will become readily apparent from the following detailed description, the appended drawings, and the accompanying claims.

BRIEF DESCRIPTION OF THE DRAWINGS

In the accompanying drawings which form part of the specification, and in which like numerals are employed to designate like parts throughout the same.

FIG. 8 is an elevated view of the training device of FIG. 7 configured to train an inside to outside path;

FIG. 9 is an elevated view of the training device of FIG. 7 configured to correct swaying;

FIG. 10 is an elevated view of the training device of FIG. 7 configured to train a proper swing plane;

FIG. 11 is an elevated view of the training device of FIG. 7 configured to correct over rotation on the backswing.

DETAILED DESCRIPTION OF THE PREFERRED EMBODIMENTS

Figure 1:
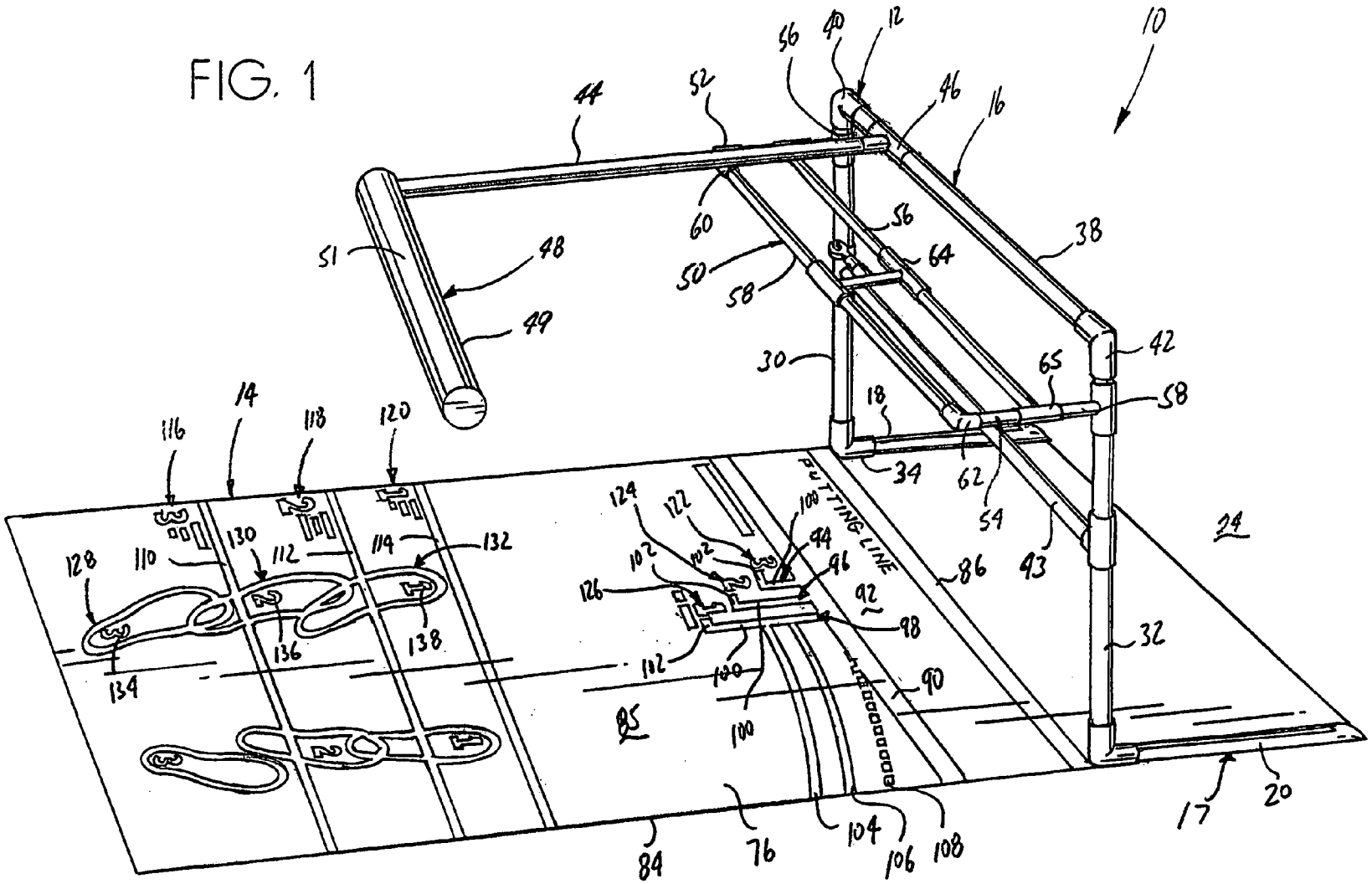
FIG. 1 is a perspective view of the golf teaching and training device of the present invention.

The invention disclosed herein is, of course, susceptible of embodiment in many different forms. Shown in the drawings and described herein below in detail are preferred embodiments of the invention. It is to be understood, however, that the present disclosure is an exemplification of the principles of the invention and does not limit the invention to the illustrated embodiments and further that the scope of the invention is delineated in the appended claims.

For ease of description, the golf teaching and training device of this invention is described in its normal use position sitting upright on a playing surface and terms such as upper, lower, horizontal, etc. are used with reference to this position.

Figure 2:
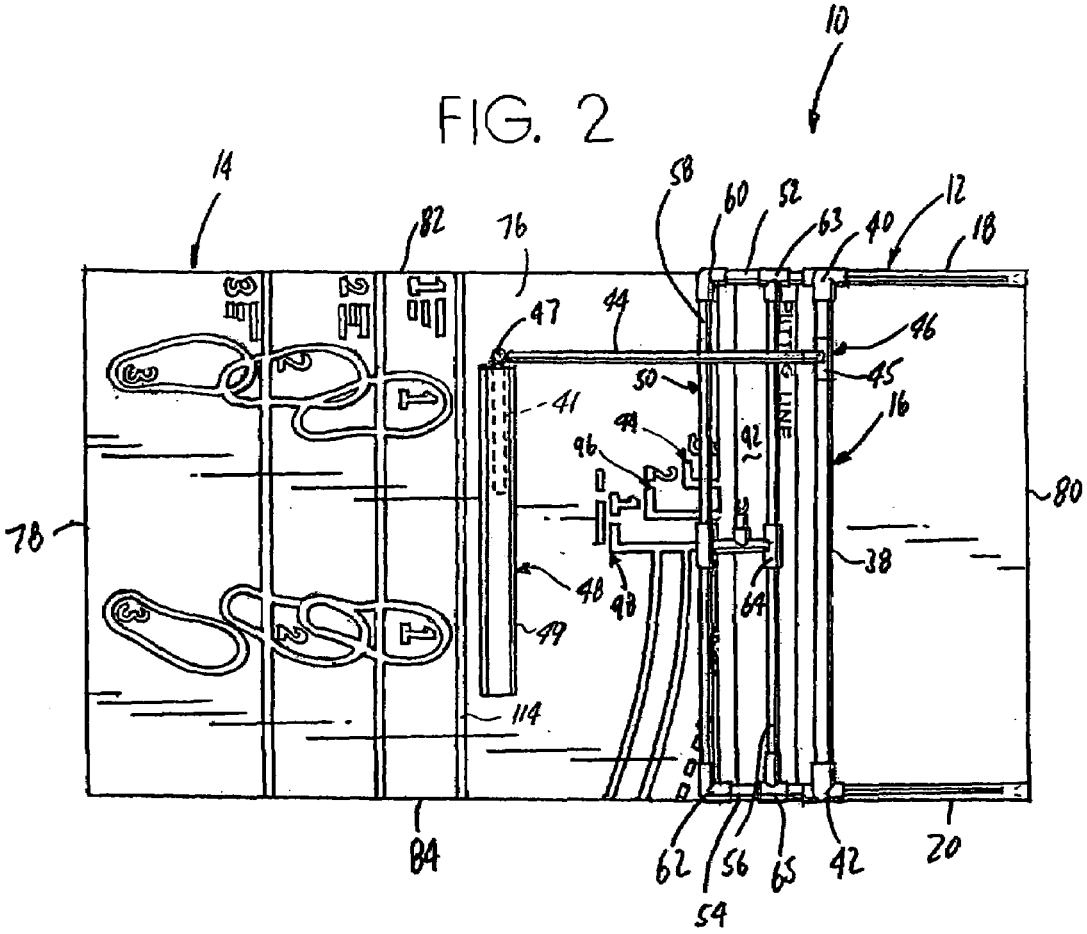
FIG. 2 is a top plan view of the device of FIG. 1.

FIGS. 1–2 depict the golf teaching and training device 10 of the present invention which, in the embodiment shown, comprises a combination swing/putting training assembly 12 and a separate foot/golf ball placement floor mat assembly 14.

The assembly 12 is made of a plastic or the like lightweight, durable material and comprises a frame or stand 16 defined in part by and including a bottom support base 17 which, in the embodiment shown, comprises a pair of elongate spaced apart and parallel hollow elongate members or bars 18 and 20 incorporating flat bottoms which allow the members 18 and 20 and thus the assembly 12 to be seated and positioned flat against the mat assembly 14 or playing surface 24. In accordance with the embodiment of FIGS. 1 and 2, the members 18 and 20 each have a length of about 14 inches.

The frame 16 additionally is defined by and includes a pair of upright tubular posts 30 and 32 extending generally normally upwardly from the front ends of the respective base members 18 and 20 in spaced-apart, vertically coplanar and parallel relationship. A pair of generally tubular ninety degree elbow joints 34 and 36 connect the posts 30 and 32 to the respective base members 18 and 20. In accordance with the embodiment of FIGS. 1–2, each of the posts 30 and 32 has a length of about 25 inches. Moreover, in accordance with the embodiment of FIGS. 1 and 2, the distance between the posts 30 and 32 is about 39 inches and the hollow base members 18 and 20 may be filled with another material such as sand, cement or the like to form a weighted base designed to prevent the assembly 12 from tipping over during the use thereof. The base, of course, can take any other form suitable to provide support for the frame such as, for example, stands adapted to receive the ends of the posts 30 and 32.

The frame 16 still further includes an elongate tubular crossbar member 38 extending generally horizontally transversely between the top ends of the posts 30 and 32 respectively in a relationship spaced from and generally parallel to and above the base members 18 and 20 and the mat assembly 14. A pair of ninety degree elbow joint members 40 and 42 connect the opposite ends of the crossbar member 38 to the top ends of the posts 30 and 32 respectively. A stabilizer crossbar 43 similar to the crossbar 38 extends between the posts 30 and 32 at a location below the crossbar 38 to stabilize and strengthen the frame 16.

In accordance with the present invention, an elongate shaft or arm 44 extends from the crossbar member 38 in a direction outwardly away from the frame 16 and the posts 30 and 32 thereof A fitting 46, including a rotatable sleeve 45 associated with the crossbar 38, connects and couples the proximal end of the arm 44 to the crossbar 38 at a position adjacent the post 30 thereby mounting the arm 44 for releasably fixable pivoting movement about the crossbar 38. Although not shown, it is understood by persons of ordinary skill in the art that the fitting 46 may incorporate any structure suitable to allow the arm 44 to be releasably positioned at a variety of positions relative to the crossbar 38 such as, for example, a ratchet, friction or like type fitting and further that the fitting 46 may alternatively be structured so as to allow rotational 360 degree movement about the crossbar 38 and lateral or horizontal pivotal side-to-side movement towards or away from the crossbar 38. It is also understood that the arm 44 may comprise any other structure cooperative with the frame 16 suitable to create and define a barrier preventing an over-the-top golf swing as explained below in more detail. In accordance with the embodiment of FIGS. 1–2, the arm 44 has a length of about 30 inches and is rotatable and pivotable about the crossbar member 38 in the up and down vertical position to a variety of releasably fixed positions of from about 8 inches to about 52 inches away from the assembly 14 and the playing surface 24.

A second padded arm 48 includes a shaft 41 coupled for pivotal movement about the opposite distal end of the arm 44 by a fitting 47 incorporating any suitable structure known to those of ordinary skill in the art to allow the shaft 41 and thus the arm 48 to pivot, swivel and/or rotate about the end of the arm 44 to a multitude of releasably fixed positions about the arm 44 and the assembly 12. The arm 48 is surrounded by a cylindrically shaped elongate hollow, protective foam pad or tube 49 which is slid over the end and the length of the arm 48. In accordance with the embodiment of FIGS. 1 and 2, the padded arm 48 is about 24 inches in length and includes a marking 51 in the form of a solid stripe running longitudinally along the top of the pad 49.

The assembly 12 further includes a generally rectangularly shaped golf club guide track 50 which is located beneath and parallel to the crossbar member 38 and is mounted to and extends outwardly from the posts 30 and 32 of the frame 16. Particularly, the assembly 12 includes a pair of elongate hollow tubular arms or shafts 52 and 54 extending generally normally outwardly from the posts 30 and 32 respectively at a location thereon proximate the upper ends of the posts 30 and 32 and the bar 38. Respective fittings 56 and 58 surrounding the posts 30 and 32 connect the respective proximal ends of the arms 52 and 54 to the posts 30 and 32 respectively. In accordance with the embodiment of FIGS. 1–2, the arms 52 and 54 have a length of about 9 inches and are positioned on the posts 30 and 32 a distance of about 18 inches away from the mat assembly 14 and playing surface 24.

The track 50 also includes a pair of slide arms or shafts 56 and 58 extending generally normally between the arms 52 and 54 in a spaced-apart and parallel relationship spaced from the frame 16 and in a relationship generally parallel to the crossbar member 38. A pair of ninety degree tubular elbow joint members 60 and 62 connect the opposed ends of the arm 58 to the distal ends of the arms 52 and 54 respectively. A pair of hollow T-type fittings 63 and 65 surround the arms 52 and 54 and secure the ends of the arm 56 to the arms 52 and 54. The arm 56 extends in a spaced and parallel relationship between the arm 58 and the posts 30 and 32.

Figure 3:
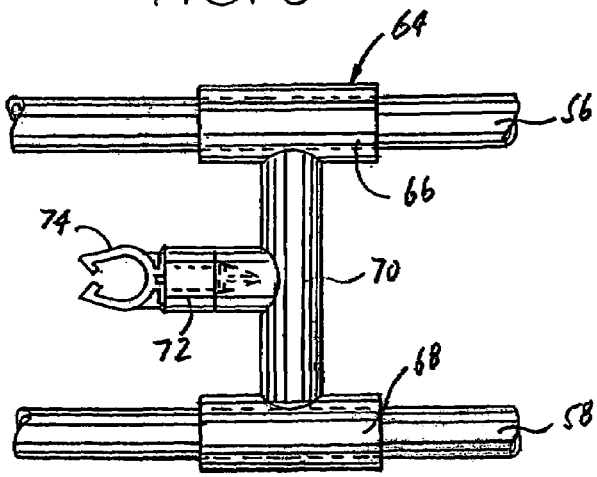
FIG. 3 is an enlarged, broken top plan view of the putter track, slide and clip of the device of FIG. 1.

As shown particularly in FIG. 3, a slide or bracket 64 is mounted to the track 50 and, more particularly, is mounted between the slide arms 56 and 58 for sliding back and forth longitudinal movement along the length of the arms 56 and 58 between the arms 52 and 54. The bracket 64 specifically includes a pair of hollow tubular collars or fittings 66 and 68 mounted to the respective arms 56 and 58 for sliding back and forth movement thereon and a tubular rod 70 extending between and connected to the collars 66 and 68 respectively. The rod 70 additionally includes a hollow tubular finger 72 extending generally unitarily normally centrally outwardly therefrom in the direction of the arm 52. A golf club shaft clip member 74 protrudes outwardly from the distal end of the hollow tubular finger 72. The slide 64 can be reversed on the track 50 so that the clip 74 faces the opposite direction to suit either a right or left handed golfer.

The foot/golf ball placement assembly 14 of the present invention comprises a generally rectangularly shaped mat 76 including peripheral transverse side edges 78 and 80, longitudinal top and bottom edges 82 and 84 respectively and a top marking surface 85. In accordance with the embodiment of FIGS. 1 and 2, the mat 76 has a length of about 54 inches and a width of about 36 inches. The mat 76 is adapted to be seated over the playing surface 24 and the assembly 12 is adapted to be seated over the mat 76 as shown in FIGS. 1–2 in a relationship wherein the two base members 18 and 20 of the assembly 12 extend along the mat 76 in an orientation generally vertically co-planarly aligned with the respective peripheral longitudinal edges 82 and 84 of the mat 76.

The mat 76 includes a first putting line marking 86 thereon in the form of a solid white line extending across the transverse width of the mat 76 between the longitudinal top and bottom edges 82 and 84 thereof in a relationship wherein the marking 86 is spaced from and parallel to the transverse mat side edge 80. In accordance with the present invention, the marking 86 is spaced a distance of about 14 inches away from the mat side edge 80 so as to allow the base 17 of the assembly 12 to be seated on the mat 76 between the mat edge 80 on one side and the putting line marking 86 on the other side in a relationship wherein the posts 30 and 32 extend upwardly from the frame 16 generally adjacent the marking 86 and the base member fittings 34 and 36 are in abutting relationship with the edge of the marking 86.

A second marking 90 also in the form of a solid white line extends along the width of the mat 76 between the longitudinal top and bottom side edges 82 and 84 thereof in a spaced and parallel relationship from the first marking 86. In accordance with the embodiment of FIGS. 1 and 2, the marking 90 extends between the marking 86 and the mat edge 78 and is spaced a distance of about 8 inches from the marking 86. The two markings 86 and 90 cooperate together to define a generally rectangularly shaped putter head guide and swing track 92 on the mat surface 85 located generally below the putting track 50 of the assembly 12.

The mat 76 still further includes a plurality of combination square club face guide and golf ball placement markings 94, 96 and 98 respectively. Each of the markings 94, 96 and 98 respectively comprises a generally L-shaped solid white line having a leg 100 extending generally normally outwardly from the outer edge of the marking 90 in the direction of and generally normal to the mat side edge 78 and a base 102 extending generally normally outwardly from the distal end of the leg 100 in the direction of the longitudinal top mat edge 82 and generally parallel to the edges 82 and 84.

The leg 100 of the club face guide marking 96 is longer than the leg 100 of the club face guide marking 94 and the leg 100 of the club face guide marking 98 is longer than the leg 100 of the club face guide marking 96. In accordance with the embodiment of FIGS. 1 and 2, the legs 100 of the markings 94, 96 and 98 have lengths of about 4, 6, and 8 inches respectively and extend respectively about 15, 18, and 21 inches away from the top mat edge 82. The club face guide markings 94, 96 and 98 extend successively on the surface 85 of the mat 76 in the direction of the bottom mat edge 84 in a spaced-apart relationship with the respective legs 100 and the bases 102 of the markings 94, 96 and 98 positioned in a parallel and spaced-apart relationship.

In accordance with the present invention, the mat 76 additionally includes a plurality of elongate and curvilinearly shaped swing take away path markings 104, 106 and 108 in the form of solid and dashed lines. The markings 104 and 106 extend in the transverse mat direction between the leg 100 of the club face guide marking 98 and the mat bottom edge 84. The dashed marking 108 extends in the transverse mat direction between the marking 90 and the bottom mat edge 84. All three markings 104, 106 and 108 extend in the longitudinal mat direction in a spaced apart and parallel relationship between the base 109 of the ball placement marking 98 and the marking 90.

Still further, the mat 76 includes a plurality of swing target markings 110, 112 and 114 comprising solid straight lines located on the mat surface 85 between the club face guide markings 94, 96 and 98 and the mat side edge 78. The respective swing target markings 110, 112 and 114 are positioned in a spaced apart and parallel relationship in the longitudinal mat direction and extend respectively in the transverse mat direction between the top and bottom longitudinal mat edges 82 and 84. In accordance with the embodiment of FIGS. 1–2, the markings 110, 112, and 114 are spaced about 12, 22, and 30 inches away respectively from the mat side edge 78 and the assembly 12 is seated over the mat 76 in a relationship wherein the padded arm 48, when viewed from above the assembly 12, is positioned just fore of the forward edge of the front swing target marking 114 in a parallel and spaced relationship thereto.

Club selection markings 116, 118 and 120 in the form of numerals and writing associated with the swing target markings 110, 112 and 114 respectively cooperate with corresponding club selection markings 122, 124 and 126 also in the form of numerals and writing associated with the club face guide markings 94, 96 and 98 respectively.

In accordance with the present invention, the club face and ball placement markings 94, 96 and 98 are appropriately positioned on the mat surface 85 in the region of the swing space defined below the length of the arm 44 and the playing surface 24. Moreover, the distance between the club face and ball placement markings 94, 96, 98 and the swing target markings 110, 112 and 114 respectively is dependent upon the particular golf club intended to be used in connection with each of the club face and ball placement markings 94, 96 and 98 respectively. For example, in accordance with the embodiment of FIGS. 1 and 2, the club face and ball placement marking 94 is intended to be used in connection with the selection and use of short irons, the marking 96 is intended to be used in connection with the selection and use of mid irons, and the marking 98 is intended to be used in connection with the selection and use of long irons and/or woods. In accordance and consistent with the golf club intended to be used with each of the respective markings 94, 96 and 98, the distance between the bases 102 of the markings 94, 96, 98 and the respective corresponding swing target markings 110, 112 and 114 is about 32, 20, and 10 inches respectively.

The mat 76 still further includes a plurality of foot placement markings 128, 130 and 132 in the form of three respective spaced apart pairs of solid foot print outline markings extending behind the respective swing target markings 110, 112 and 114 in a relationship generally normal to the respective markings 110, 112 and 114 where the front or toe region of the respective footprints face and are positioned adjacent the back edges of the respective markings 110, 112 and 114.

The three pairs of footprints 128, 130 and 132 include respective club selection numerical markings 134, 136 and 138 corresponding to and coordinating with the respective numerical club selection markings 116, 118 and 120 associated with both the respective swing target markings 110, 112 and 114 and the respective club selection markings 122, 124 and 126 associated with the respective club face and ball placement markings 94, 96 and 98.

While the preferred embodiment of the mat 76 has been described herein as including markings painted on or otherwise suitably applied directly to the mat surface 85, it is understood that the markings may likewise comprise correspondingly shaped cut-outs formed in the mat surface 85 and that a water soluble paint may be spread over the mat surface 85 over the cut-outs so that appropriate markings corresponding to the cut-outs are formed on the playing surface 24 below the mat 76. In this fashion, practice sessions may be performed on a real grass or the like playing surface 24 instead of over the mat 76.

Selected ones of the available methods of using the device 10 of the present invention will now be described with reference to FIGS. 4–6.

Figure 4:
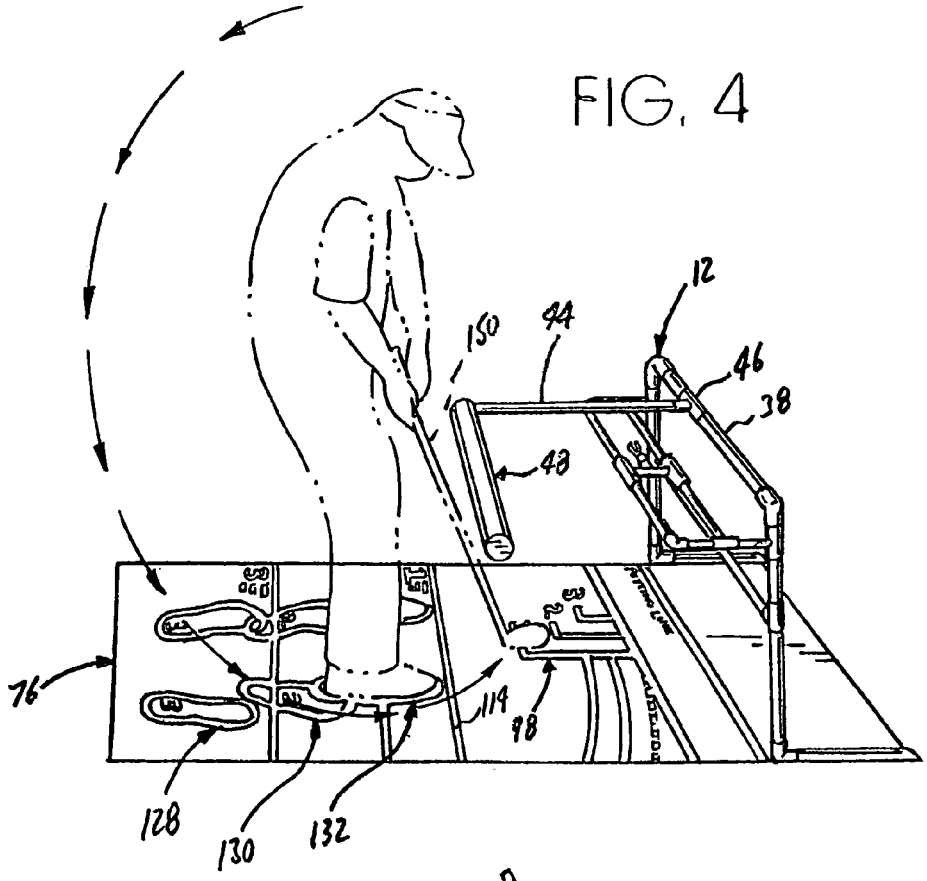
FIG. 4 is a perspective, part phantom view depicting the method of using the device of the present invention to teach and practice the correct inside swing of a golf club.

Particularly, FIG. 4 depicts the use of the device 10 wherein a golf ball (not shown because located directly in front of the head of the golf club 150) is placed on the mat 76 directly over the ball placement marking 98 and a golfer stands on the mat 76 facing the assembly 12 in a relationship wherein the golfer's feet are positioned over the footprints 132. Although not shown in any of the drawings or described herein in any detail, it is understood that the golf ball could likewise alternatively be placed over and in alignment with either of the other two ball placement markings 94 and 96 depending upon the golf club which is selected for use and further that the golfer, in accordance with the numeral marking associated with the selected ball placement marking, would stand over either of the two alternate footprint markings 128 or 130 corresponding numerically to the ball placement markings 94 and 96.

In accordance with the present invention, the assembly 12 teaches a golfer to practice the fundamentally correct takeaway, set-up and "inside to out" golf swing path depicted in FIG. 4 which requires that the head and shaft of the golf club 150 to travel in a counter clockwise direction below the padded arm 48 of the arm 48 and through the inside swing space or area defined along the length of and below and between the arm 44 and the mat 76 or playing surface 24.

By allowing only an "inside to out" swing path, the assembly 12 of the present invention eliminates the most common defect found in the swing of more than 95% of the 30.4 million U.S. golfers today, i.e., slicing of the golf ball due to either "casting" or "swinging over the top." The arms 44 and 48 cooperate together to define a barrier extending away from the frame 16 which prevents the "over the top" swing most typically associated with slicing of a golf ball since the use of an "over the top" swing would result in the shaft of the golf club 150 striking the top of the padded arm 48 and/or arm 44. The skill level of the golfer determines the height at which the arm 48 is spaced from the mat 76 and the playing surface 24, i.e., the height is reduced as the level of skill or proficiency increases.

Also in accordance with the present invention, placement of the golf ball in the same peripheral viewing area as the padded arm 48 of the assembly 12 requires a golfer to fix his/her gaze at both the golf ball and the arm 48 during the entire swing sequence thus eliminating another of the common defects found in the swing of a majority of golfers, i.e., the movement of the head and gaze away from the ball during the swing sequence. Still further, the marking 51 on the pad 49 of the arm 48 provides a visual alignment guide.

Of course, with the assembly 12 of the present invention, the results on the flight of the golf ball following the strike thereof are immediately identifiable and recognizable because the device 10 involves practice with actual golf clubs and the striking of actual golf balls toward an actual golf course target rather than practice with a simulated golf ball or a simulated golf course target as is the case with several of the swing training devices available today.

In addition to using the device to stop the "over the top" swing, the device can also be used to check and improve a user's swing plane and to stop excessive inside swing paths which can lead to the "hooking" of golf balls. In these two instances, both uses are performed by setting up the device behind the golfer as shown in FIG. 5 rather than in front of the golfer as in FIG. 4. In this configuration, the arm 44 is rotated away from the track 50 and the position shown in FIGS. 1–4 to a releasably fixed position about 25 degrees from the vertical plane extending upwardly through the crossbar 38 and the arm 48 is rotated about the end of the arm 44 to a releasably fixed position of about 115 degrees relative to and from the arm 44.

Figure 5:
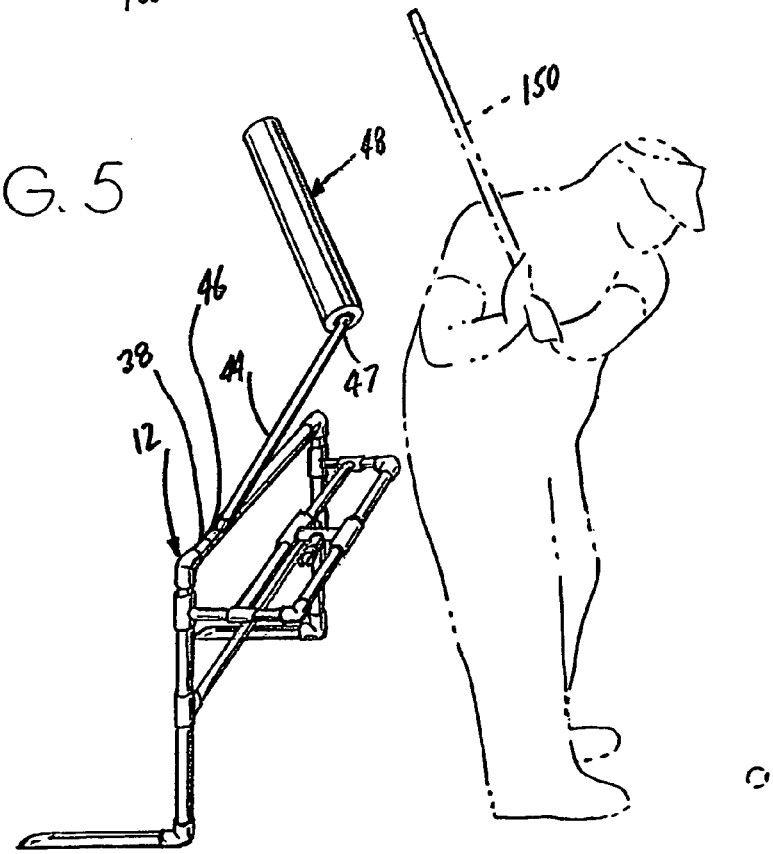
FIG. 5 is a perspective, part phantom view depicting a different position of the device arms for teaching and practicing the proper non-hooking swing plane position.

To stop a hook due to an excessive inside swing path, the padded arm 48 in the configuration and orientation of FIG. 5 serves as a barrier which prevents the golfer from swinging too far from the inside and forces the swing to take a more upright up and down and "over the top" motion and path in front of the arm 48. The configuration of FIG. 5 also allows a golfer to practice his/her proper swing plane by teaching a golfer to position the shaft of the golf club 150 on the back set up swing into a position parallel to and spaced from the padded arm 48.

Figure 6:
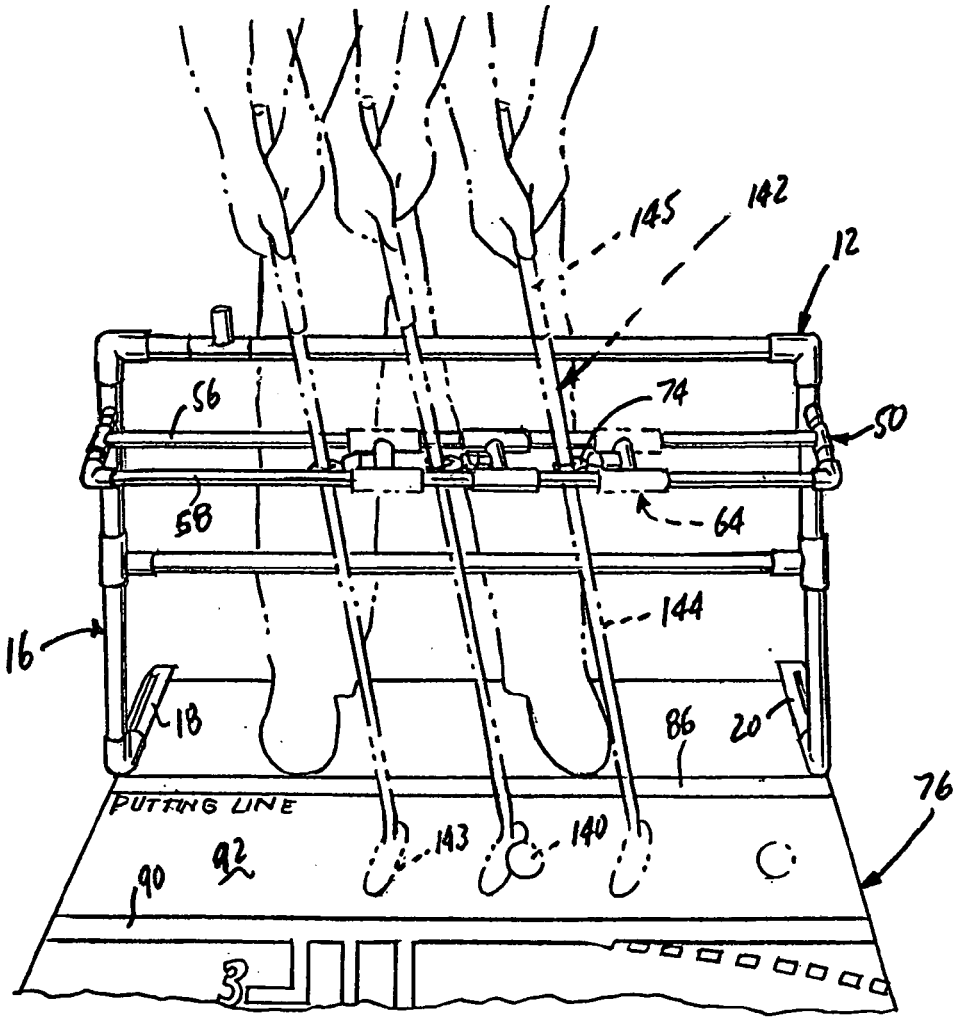
FIG. 6 is a perspective, part phantom sequential view depicting the method of using the device of the present invention for practicing a proper straight back and forth putting stroke.

FIG. 6 depicts the use of the assembly 12 as a putting training device. Specifically, a putter club 142 is adapted to be slid downwardly through and between the slide arms 56 and 58 of the track 50 into a relationship wherein the head 143 thereof is positioned in abutting relationship with the mat surface 85 in an orientation generally normal to the putting line marking 86. In accordance with the present invention, the shaft 144 of the club 142 is adapted to be removably and releasably received and secured to the clip 74 on the slide 64 and the golfer grasps the handle 145 of the club 142 at a location above and spaced from the track 50 and the assembly 12. In accordance with this particular use of the assembly 12, a golfer stands inside the frame 16 of the assembly 12 and, more particularly, inside the space defined by the members 18, 20 and 22 of the base 17 in an orientation wherein the toes of the golfer's feet face the track 50 and are positioned just behind the putting line marking 86 on the surface 85 of the mat 76.

In accordance with the invention, the assembly 12 also teaches a golfer to hold the putter 142 in a position square to the putting target with his/her eyes directly above the golf ball 140 seated on the surface of the putting track 92 defined on the mat surface 85. As depicted in phantom in FIG. 5, the bracket 64 is initially slidable backward along the track 50 in response to the back stroke movement of the putter 142 followed by the forward sliding movement of the bracket 64 along the track 50 in response to the forward stroke movement of the putter 142. In accordance with the present invention, the track 50 guides both the golfer's backward and then forward putting strokes along a straight line throughout the stroke follow through for teaching the fundamentally correct straight back and forth pendulum style putting stroke.

It will be readily apparent from the foregoing detailed description of the invention and from the illustrations thereof that numerous variations and modifications may be effected without departing from the true spirit and scope of the novel concepts or principles of this invention. For example, and without limitation, it is understood that the assembly 12 may be used without the mat 76 as shown in, for example, FIG. 5, that the arm 44 may be removed from the assembly 12 as shown in FIG. 6 thus allowing the assembly 12 to be used simply as a putting stroke teaching device, that the track 50 could be removed from the assembly 12 thus allowing the assembly 12 to be used strictly as a golf swing teaching device and further that the pivoting and rotational ability of arms 44 and 48 will allow the device to be utilized in a multitude of different configurations and positions for teaching, training, and practicing a multitude of golf swings.

Figure 7:
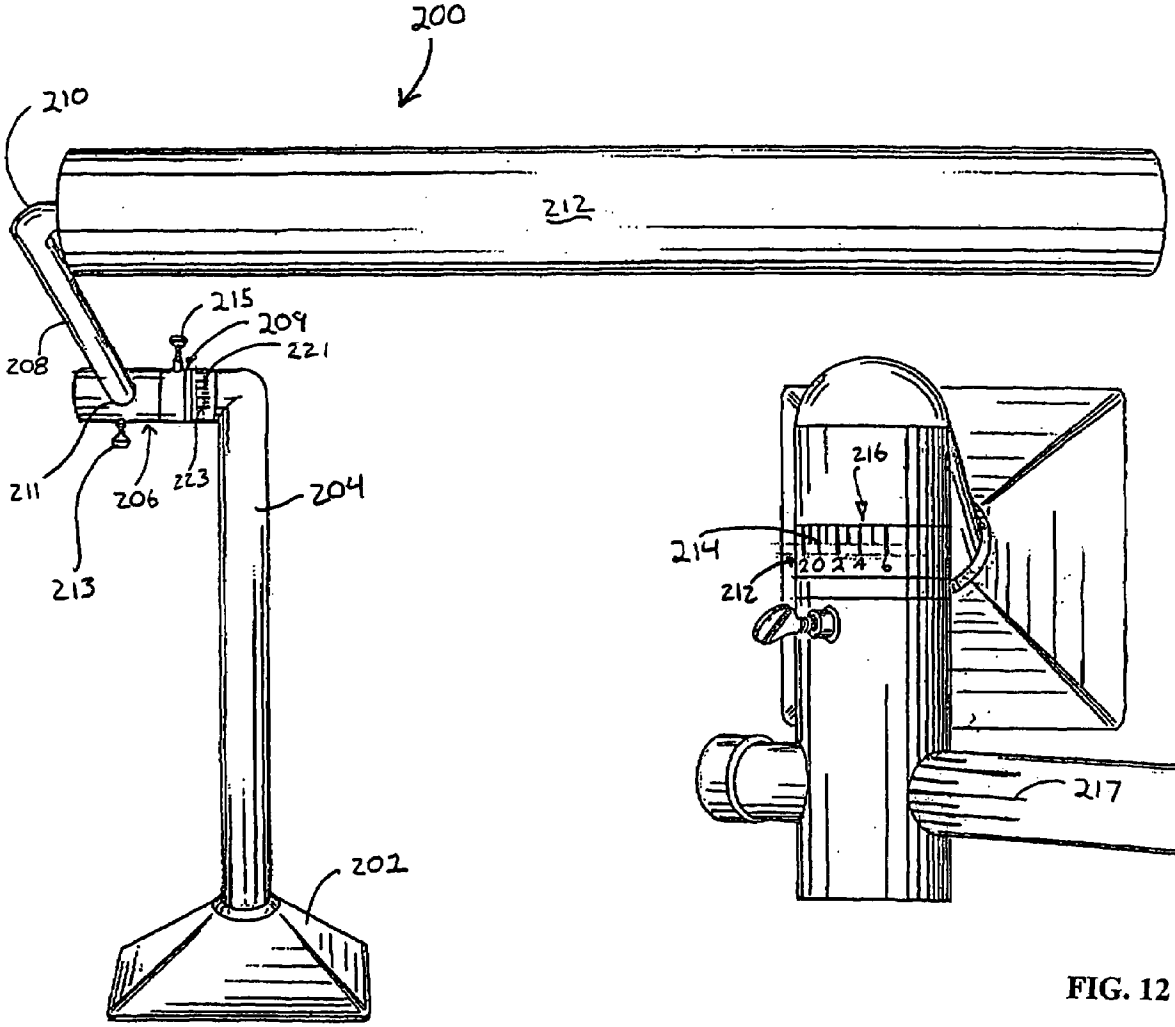
FIG. 7 is an elevated view of an alternate embodiment of the training device.

FIG. 7 shows yet another embodiment of the present invention. In this embodiment, a multi-positional swing training device 200 having adjustable configurations suitable for addressing a plurality of swing flaws is depicted. The training device 200 includes a base 202, an upright member 204 extending vertically from the base 202 and having a joint member 206. The base 202 and upright member 204 are shown as two separate components, however, this is not necessary. The base 202, upright member 204, and joint member 206 may be integrally formed in any combination.

An elongate arm 208, which defines a distal end portion 210, extends from the upright member 204 and is detachably secured therewith by the joint member 206. As such, the elongate arm 210 is operatively connected with the upright member 204 and base 202. In the present embodiment, the joint member comprises a coupling 209 with a pin 215 that may be loosened to enable the arm 208 to pivot relative to the base 202 thereby raising or lowering the height of the distal end portion 210. The joint member 206 also includes a sleeve 211 through which the arm 208 extends. By loosening pin 213, the arm 202 may be rotated to the desired orientation and secured in place by tightening pin 213. Similarly, the arm 208 may be retracted or extended by sliding the arm 208 through sleeve 211, and thereby change the distance of the distal end portion 210 from the joint member 206. Other embodiments of the joint member 206, such as a ball joint, will be readily apparent to those of skill in the art.

A guide member 212 resembling an elongated shaft extends perpendicularly from the distal end portion 210 of the arm, wherein the orientation of the guide member relative to the base is rotationally and pivotally adjustable by adjustment of the arm. The guide member 212 is depicted as a cylindrical structure, however, this is not required. The guide member 212 is preferably cylindrical or tubular, however, it may be any elongated shape, and may include a taper or other contours if desired. The guide member 212 is preferably made of a foam material. The guide member 212 is also preferably of a substantial length of about 26 inches or more. By having a substantial length, the guide member 212 provides a sufficient visual and physical guide or barrier for the golfer. For example, with respect to a configuration for the training device 200 where shifting of weight or swaying of the golfer are addressed, as is discussed below, the guide member 212 should be of sufficient length to extend a substantial portion of the golfer's leg.

As described, the positions of the arm 208, and accordingly, the guide member 212 are rotationally and pivotally adjustably relative to the base 202. The rotational movement is shown by arrow 214. The pivotal movement is the vertical adjustment of the arm 208 relative to the base, such as shown by arrow 216.

The present invention enables a golfer to adjust the device to address numerous common flaws to a golf swing. For example, one common problem is the result of swinging along an outside to inside path. This results in a ball either slicing, or being pulled to the left of target (for a right handed golfer). It is desirable that a golf swing move along a straight path or an inside to outside path. Referring to FIG. 8, a setup for addressing this issue is depicted. As shown, the guide member 212 and arm 208 are oriented so the pad is parallel to the ground at a level approximating the golfer's hands or slightly below. The golfer may then use the guide 212 as a physical and visual guide to assure his of her hands travel within the guide, thereby preventing the outside to inside swing path. The adjustability of the position of the arm 208 and guide member 212 enables a proper setup to be achieved for any variety of body sizes and types. For example, a taller player may need to pivot the arm 208 so the guide member 212 is higher off the ground. Alternatively, a junior golfer can lower the arm 208, or retract the arm 208 such that the lateral distance of the guide member 212 from the base is lessened.

Another setup for the training device 202 is shown in FIG. 9. The guide member 212 and arm 208 are adjusted such that the guide member 212 is essentially perpendicular to the ground. Such a setup provides immediate tactile feedback evidencing another common flaw, namely, improper weight shift. By positioning the training device 202 and the guide member 212 against the front leg of the golfer, immediate tactile feedback is provided to indicate proper weight shift. This same set up can be utilized to indicate undesired swaying during the swing by by positioning the training device 202 next to the player's back leg.

Another common problem relates to maintaining a proper swing plane. A set up to correct this problem is shown in FIG. 10. The arm 208 and guide member 212 are pivoted upwards and rotated such that a visual guide for proper swing plane is provided. Again, the height of the guide member 212 can be adjusted by extending or retracting the arm 208 with the joint member 206.

Yet another common problem is over rotation on the backswing. The set up depicted in FIG. 11 helps to correct this flaw by providing tactile feedback for the limit for how far back a swing should be made. As shown, the arm 208 is pivoted to extend perpendicularly to the ground and the arm member is rotated to position the guide member 212 above the golfer's back shoulder.

In the examples discussed, the guide member is utilized to provide a guide for the golfer's body, however, it should be appreciated that proper adjustment of the arm 208 and guide member 212 can be utilized to guide the club head as well.

Figure 12:
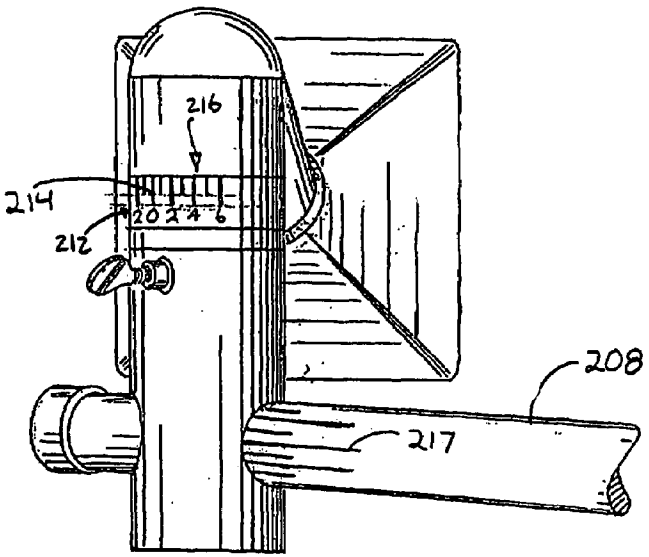
FIG. 12 is a perspective view of a dial for the training device of FIG. 7.

Referring to FIG. 12, in order to facilitate the repeatability of drills, the joint member 206 preferably includes a dial 212 having a plurality of indicators or markings 214 thereon. An identifier, such as arrow 216, in cooperation with the markings 214 provides a means for identifying the relative pivotal position of the arm 208 relative to the base 202. Similar indicators, such as azimuth markings 217, can be provided on the arm 208 to indicate the amount of rotation of the arm 208. Longitudinal markings 219 can also be provided along arm 208 to indicate extension or retraction of the arm relative to the joint member 206. By recording and resetting the dial 212 to certain markings, the desired configurations for the training device 200 can be readily established. Although not shown in the figures, the dial 212 preferably includes markings traversing the entire circumference of the joint member 206. It is particularly advantageous for the dial to include a top half of markings 221 and a bottom half of markings 223, which are identical, to accommodate both left and right handed golfers.

The foregoing descriptions are to be taken as illustrative, but not limiting. The invention disclosed herein is susceptible of embodiment in many different forms. Shown in the drawings and described are preferred embodiments of the invention. It is to be understood, however, that the present disclosure is an exemplification of the principles of the invention and does not limit the invention to the illustrated embodiments. Still other variants within the spirit and scope of the present invention will readily present themselves to those skilled in the art.

I claim:

1. A multi-positional swing training device having adjustable configurations suitable for addressing a plurality of swing flaws, the training device comprising:

a base;

an upright member extending vertically from the base and having a joint member:

an elongate arm extending from the upright member and having a distal end portion, the arm being operatively connected with the upright member and adjustably secured with the joint:

a dial having indicators thereon, wherein the dial is suitable for providing a reference for positioning of the arm relative to the base; and a guide member resembling an elongated shaft extending from about the distal end portion of the arm, wherein the orientation of the guide member relative to the base is rotationally and pivotally adjustable by adjustment of the arm.

2. The training device of claim 1, wherein the dial comprises a top half of markings and a bottom half of markings, the top half of markings and the bottom half of markings being identical to one another.

3. The training device of claim 1, wherein the guide member is of a length of at least about 26 inches.

4. The training device of claim 1, wherein the extension of the arm from the upright member is adjustable.

5. The training device of claim 4, wherein the arm comprises longitudinal markings to indicate Longitudinal positioning of the arm relative to the upright member.

6. The training device of claim 1, wherein the guide member extends perpendicularly from the distal end portion of the arm.

7. A swing training device configurable in multiple positions and suitable for addressing a plurality of swing flaws, the training device comprising:

a base having an upright member extending vertically therefrom, the upright member having a distal end portion, the distal end portion comprising an adjustable joint member;

an elongate arm detachably securable with the adjustable joint member and extending away from the upright member; the elongate arm being rotatable and pivotable relative to the base;

an elongated shaft-shaped guide member extending from a distal end portion of the arm, wherein the orientation of the guide member relative to the base is rotationally and pivotally adjustable by rotating and pivoting the arm; and a dial having a plurality of indicators thereon, wherein the indicators denote reference points representing the position of the arm relative to the base.

8. The training device of claim 7, wherein the dial comprises a top half of markings and a bottom half of markings, the top half of markings and the bottom half of markings being identical to one another.

9. The training device of claim 7, wherein the guide member is of a length of at least about 26 inches.

10. The training device of claim 7, wherein the extension of the arm from the upright member is adjustable.

11. The training device of claim 10, wherein the arm comprises longitudinal markings to indicate longitudinal positioning of the arm relative to the upright member.

12. The training device of claim 7, wherein the guide member extends perpendicularly from the arm.

13. A swing training device suitable for addressing a plurality of swing flaws, the training device comprising:

a base;

an elongate arm operatively connected with the base by an adjustable joint member, the elongate arm being detachably secured with the joint member and rotatable and pivotable relative to the base, the joint member further comprising a dial having at least one marking thereon indicating the position of the arm relative to the base; and an elongated guide member extending substantially perpendicularly from a distal end portion of the arm, wherein the orientation of the guide member relative to the base is rotationally and pivotally adjustable by rotating and pivoting the arm.

* * * * *